United States Patent [19]

Fukuroi

[11] 4,312,102

[45] Jan. 26, 1982

[54] SEALING SLIDE FASTENER STRINGER

[75] Inventor: Takeo Fukuroi, Uozu, Japan

[73] Assignee: Yoshida Kogyo K K, Tokyo, Japan

[21] Appl. No.: 135,361

[22] Filed: Mar. 31, 1980

[30] Foreign Application Priority Data

Apr. 26, 1979 [JP] Japan ..... 54-56052[U]

[51] Int. Cl.[3] ..... A44B 19/00

[52] U.S. Cl. ..... 24/205.1 R; 24/205.16 R

[58] Field of Search ..... 24/205.1 R, 205.16 R

[56] References Cited

U.S. PATENT DOCUMENTS

| | | | |
|---|---|---|---|
| 2,910,754 | 11/1959 | Morin | 24/205.1 R |
| 2,979,796 | 4/1961 | Morin | 24/205.1 R |
| 3,001,905 | 9/1961 | Morin | 24/205.1 R |
| 3,114,953 | 12/1963 | Doelter | 24/205.1 R |
| 3,115,690 | 12/1963 | Morin | 24/205.1 R |
| 3,238,285 | 3/1966 | Morin | 24/205.1 R |
| 3,409,953 | 11/1968 | Briscoe | 24/205.1 R |

*Primary Examiner*—Roy D. Frazier
*Assistant Examiner*—Peter A. Aschenbrenner
*Attorney, Agent, or Firm*—Bucknam and Archer

[57] ABSTRACT

A sealing slide fastener stringer includes a stringer tape made of synthetic rubber and a series of coupling elements of synthetic resin injection-molded on a longitudinal edge portion of the stringer tape. The stringer tape has a thickened sealing member along the longitudinal edge portion. Each coupling element includes a pair of members one on each side of the tape, each comprised of a leg on the edge portion, a neck on the sealing member, and a coupling head projecting beyond the sealing member. The legs are interconnected by a first connector extending through the edge portion, and the necks are interconnected by a second connector extending through the sealing member. The first and second connectors may either be integral or comprise rivets. A single integral connector may alternatively be used to connect the legs and necks of the coupling element members.

10 Claims, 7 Drawing Figures

SEALING SLIDE FASTENER STRINGER

BACKGROUND OF THE INVENTION

1. Field of the Invention

The present invention relates to a slide fastener stringer of the airtight or watertight type.

2. Prior Art

A known form of watertight slide fastener stringer is shown in U.S. Pat. No. 2,910,754, issued Nov. 3, 1959. With this type of arrangement, a pair of coupling element halves one on each side of a stringer tape are interconnected and attached to the tape only by an integral connector remote from their coupling heads that project beyond a thickened or beaded edge of the tape. When subjected to a severe thrust applied perpendicularly to the plane of the slide fastener, the interdigitating coupling heads tend to be yielded in a direction away from the stringer tapes, and the thickened edges of the tapes could be displaced out of sealing contact with each other. Under heavier load conditions, the coupling elements are liable to be ruptured because of their relatively weak strength of attachment to the tapes. The prior sealing slide fastener is therefore unreliable in applications in which it will undergo a great amount of pressure.

SUMMARY OF THE INVENTION

Each coupling element on a stringer tape includes a pair of members one on each side of the tape which are interconnected and attached to the tape by a connector extending through an aperture in a longitudinal thickened edge of the tape between a pair of necks of the respective coupling element members. The connector may be integral with or may comprise a rivet extending through such coupling element members. A modified connector is integral with the necks and legs of a pair of coupling element members and extends through an aperture which is formed partly in the thickened edge and partly in a tape portion adjacent to the thickened edge.

It is an object of the present invention to provide a sealing slide fastener stringer which is reliable in fluid-tightness for a wide variety of severe applications.

Another object of the present invention is to provide a sealing slide fastener stringer including a series of coupling elements secured to the stringer tape with increased stability.

Still another object of the present invention is to provide a sealing slide fastener stringer which is rugged in structure.

The above and other objects, features and advantages of the present invention will become apparent from the following description when taken in conjunction with the accompanying drawings which show certain preferred embodiments by way of illustrative example.

DETAILED DESCRIPTION

Figure 1:
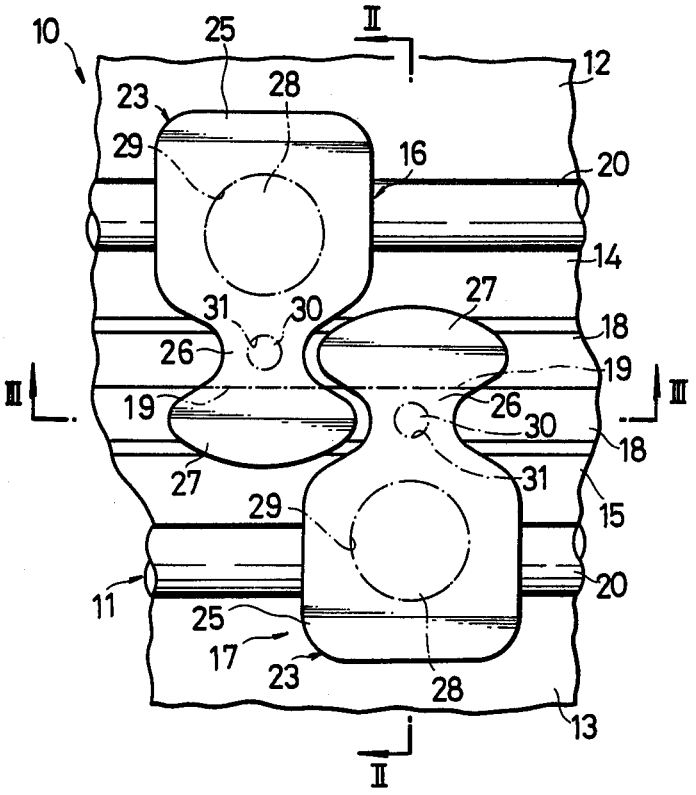
FIG. 1 is a fragmentary plan view of a pair of coupled slide fastener stringers according to an embodiment of the present invention.
Figure 2:
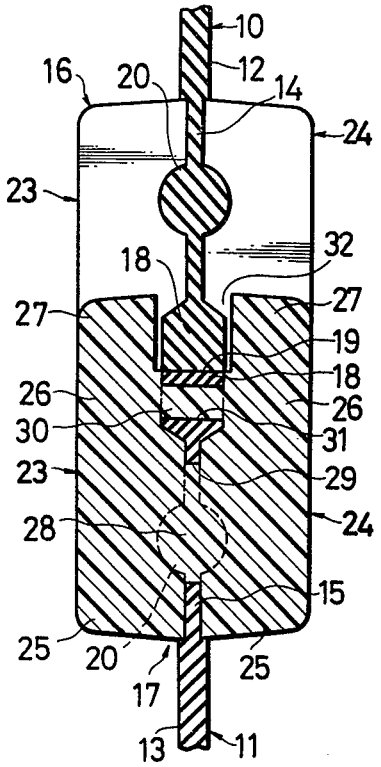
FIG. 2 is a cross-sectional view taken along line II—II of FIG. 1.
Figure 3:
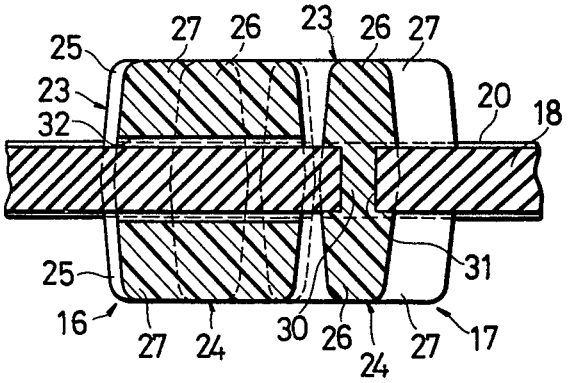
FIG. 3 is a cross-sectional view taken along line III—III of FIG. 1.

As shown in FIGS. 1 through 3, a pair of sealing slide fastener stringers 10,11 that are coupled together are comprised of a pair of respective stringer tapes 12,13 made of a fluid-tight material such as synthetic rubber and including a pair of confronting longitudinal edge portions 14,15, respectively, that are thinner than the remainder of the tapes 12,13. The longitudinal edge portions 14,15 support thereon series of coupling elements or scoops 16,17 (only one shown on each stringer tape for clarity) made of synthetic resin injection-molded on the edge portions 14,15. Each of the stringer tapes 12,13 has a thickened or enlarged sealing member 18 having a thickness greater than that of the tape proper and extending along the longitudinal edge portion 14,15. The thickened sealing member 18 includes a sealing edge or surface 19 that lies in a plane substantially perpendicular to the plane of the stringer tapes 12,13. When the slider fastener stringers 10,11 are coupled together, the sealing surfaces 19,19 are pressed edgewise against each other so that the slide fastener stringers 10,11 serve as a sealing slide fastener. Each of the stringer tapes 12,13 also includes a longitudinal reinforcing member 20 of a circular cross section spaced laterally from the thickened sealing member 18, the reinforcing member 20 giving the edge portion 14,15 a required degree of rigidity for positionally stabilizing the coupling elements 16,17 thereon.

Each of the coupling elements 16,17 comprises a pair of members 23,24 disposed one on each side of one of the stringer tapes 12,13, and extending transversely thereof. Each of the coupling element members 23,24 is composed of a leg 25 lying on one of the longitudinal edge portions 14,15, a neck 26 disposed on the thickened sealing member 18, and a coupling head 27 extending beyond the thickened sealing member 18 away from the leg 25. As best illustrated in FIG. 2, a first integral connector 28 of a cylindrical shape extends through a first aperture 29 in the longitudinal tape edge portion 14,15 and between the legs 25,25 of the coupling element members 23,24, the aperture 29 intersecting the reinforcing member 20. A second integral connector 30 of a cylindrical shape which is smaller in diameter than the first integral connector 28, extends through a second aperture 31 in the thickened sealing member 18 and between the necks 26,26 of the coupling element members 23,24. With this arrangement, the coupling element members 23,24 or the coupling elements 16,17 are anchored in place on the stringer tapes 12,13 as their necks 26,26 as well as their legs 25,25 are interconnected with the stringer tape 12,13 sandwiched therebetween. The secure interconnection between the necks 26,26 is particularly advantageous in that they are prevented from being displaced or yielded away from the tape 12,13 under a severe thrust which is normally concentrated on the thickened sealing members 18,18 that are merely held in pressed contact with each other during use of the sealing slide fastener.

The coupling heads 27,27 of the coupling element members 23,24 jointly define therebetween a slot 32 extending longitudinally along the thickened sealing member 18 with the sealing surface 19 facing into the slot 32, the slot 32 being wider than the thickness of the sealing member 18 so as to facilitate the insertion thereinto of the sealing member 18 of the opposite stringer and to accommodate lateral expansion of the sealing member 18 as it is forcibly pressed against the companion sealing member 18.

When the slide fastener stringers 10,11 are coupled together, the sealing member 18 of one of the stringers 10,11 is securely trapped in the slot 32 or constrained between the coupling heads 27,27 of the other stringer which are adjacent to and integral with the necks 26,26 interconnected by the second integral connector 30. Therefore, the longitudinal tape edge portions 14,15 of the coupled stringers 10,11 are highly resistant to thrusting forces applied perpendicularly tending to split open the coupled slide fastener stringers 10,11.

Figure 4:
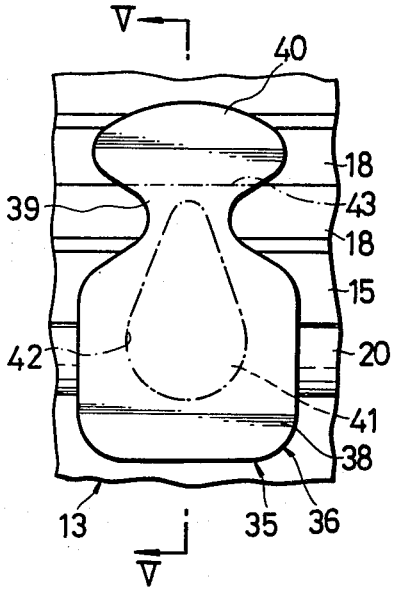
FIG. 4 is a fragmentary plan view of a modified slide fastener stringer.
Figure 5:
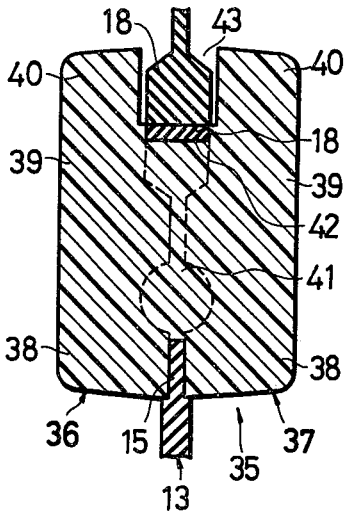
FIG. 5 is a cross-sectional view taken along line V—V of FIG. 4.

FIGS. 4 and 5 illustrate a slide fastener coupling element 35 comprising a pair of members 36,37 disposed one on each side of the stringer tape 13. Each of the coupling elements 36,37 includes a leg 38 on the longitudinal edge portion 15, a neck 39 on the thickened sealing member 18, and a coupling head 40 extending beyond the thickened sealing member 18 away from the leg 38. An integral connector 41 of a substantial oval cross section extends through a complementarily shaped aperture 42 in the stringer tape 13 and between the legs 38,38 and between the necks 39,39 of the coupling element members 36,37. The integral connector 41 has its major axis extending transversely of the stringer tape 13 with one longitudinal end as viewed cross-sectionally intersecting the thickened sealing member 18 and the other longitudinal end intersecting the reinforcing member 20. According to the modification shown in FIGS. 4 and 5, the coupling element members 36,37 are more securely connected to each other and to the stringer tape 13 by the single extensive connector 41 than the coupling element members 23,24 interconnected by the two connectors 28,30 as shown in FIGS. 1 through 3.

Figure 6:
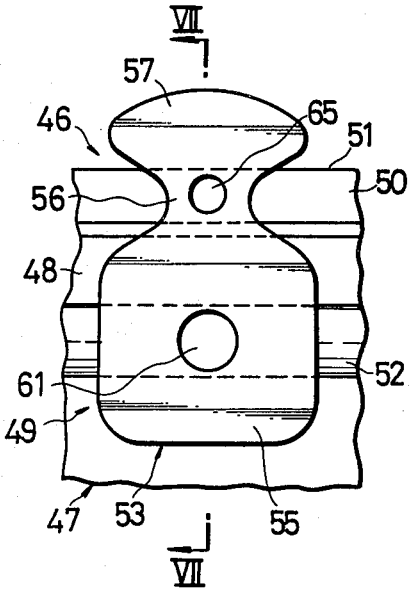
FIG. 6 is a fragmentary plan view of a slide fastener stringer according to another embodiment.
Figure 7:
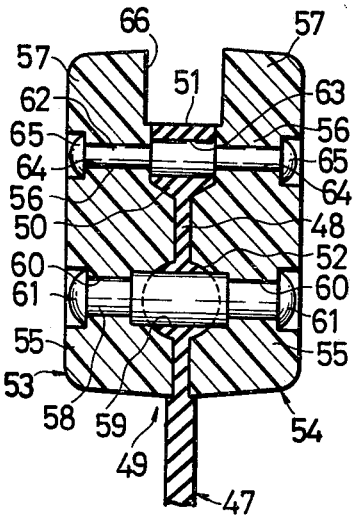
FIG. 7 is a cross-sectional view taken along line VII—VII of FIG. 6.

In FIGS. 6 and 7, a slide fastener stringer 46 according to another embodiment comprises a stringer tape 47 including a longitudinal edge portion 48 supporting thereon a plurality of coupling elements 49 (one shown in FIGS. 6 and 7). The stringer tape 47 also has a thickened sealing member 50 extending along the longitudinal edge portion 48 and having a sealing edge or surface 51 lying in a plane perpendicular to the plane of the stringer tape 47. A longitudinal reinforcing member 52 is located at the longitudinal edge portion 48 in spaced relation to the thickened sealing member 50.

Each coupling element 49 includes a pair of members 53,54 disposed one on each side of the stringer tape 47 and each comprising a leg 55 on the longitudinal edge portion 48, a neck 56 on the thickened sealing member 50, and a coupling head 57 projecting beyond the thickened sealing member 50. The legs 55,55 of the coupling element members 53,54 are interconnected by a first rivet 58 extending through a first aperture 59 in the longitudinal edge portion 48 and holes 60,60 in the legs 55,55, the first rivet 58 having rivet heads 61,61 staked on the legs 55,55. A second rivet 62 extends through a second aperture 63 in the thickened sealing member 50 and holes 64,64 in the necks 56,56, the second rivet 62 having rivet heads 65,65 staked on the necks 56,56 to connect them together. The coupling heads 57,57 jointly define a slot 66 extending longitudinally of the stringer tape 47 and in which the sealing surface 51 is exposed for pressed contact with the confronting sealing surface of an opposite slide fastener stringer. While the first and second rivets 58,65 are preferably made of metal, they may be made of synthetic resin, in which case their rivet heads are formed by ultrasonic welding.

While certain preferred embodiments have been shown and described in detail, it should be understood that changes and modifications may be made therein without departing from the scope of the appended claims.

What is claimed is:

1. A sealing slide fastener stringer comprising:

(a) a stringer tape having a thickened sealing member along a longitudinal edge portion thereof; and (b) a series of coupling elements mounted on said longitudinal edge portion, each of said coupling elements comprising a pair of members one on each side of said stringer tape and each including a leg disposed on said longitudinal edge portion, a neck disposed on said thickened sealing member, and a coupling head extending beyond said thickened sealing member away from said leg, first connector means extending through said longitudinal edge portion and interconnecting the legs of said members of the coupling element, second connector means extending through said thickened sealing member and interconnecting necks of said members of the coupling element, said coupling heads jointly defining therebetween a slot extending longitudinally along said thickened sealing member, and said thickened sealing member having a surface facing into said slot.

2. A sealing slide fastener stringer according to claim 1, said first connector means having a circular cross section and said second connector means having a circular cross section of a diameter smaller than that of said first connector means.

3. A sealing slide fastener stringer according to claim 1, said first and second connector means being integral with said members of the coupling element.

4. A sealing slide fastener stringer according to claim 1, said first and second connector means comprising rivets, respectively, extending through said members of the coupling element.

5. A sealing slide fastener stringer according to claim 1, said stringer tape including a longitudinal reinforcing member spaced from said thickened sealing member, said first connector means intersecting said reinforcing member.

6. A sealing slide fastener stringer according to claim 5, said longitudinal reinforcing member being of a circular cross section.

7. A sealing slide fastener stringer comprising:

(a) a stringer tape having a thickened sealing member along a longitudinal edge portion thereof; and (b) a series of coupling elements mounted on said longitudinal edge portion, each of said coupling elements comprising a pair of members one on each side of said stringer tape and each including a leg disposed on said longitudinal edge portion, a neck disposed on said thickened sealing member, and a coupling head extending beyond said thickened sealing member away from said leg, integral connector means extending through said longitudinal edge portion and thickened sealing member of the tape and interconnecting the legs and necks of said members of the coupling element, said coupling heads jointly defining therebetween a slot extending longitudinally along said thickened sealing member, and said thickened sealing member having a surface facing into said slot.

8. A sealing slide fastener stringer according to claim 7, said integral connector means having a substantial oval cross section with its major axis extending transversely of said stringer tape.

9. A sealing slide fastener stringer according to claim 8, said substantial oval cross section having a longitudinal end thereof located in said thickened sealing member.

10. A sealing slide fastener stringer according to claim 8, said stringer tape including a longitudinal reinforcing member spaced from said thickened sealing member, said substantially oval cross section having a longitudinal end thereof intersecting said reinforcing member.

* * * * *